US009637694B2

(12) United States Patent
Evans et al.

(10) Patent No.: US 9,637,694 B2
(45) Date of Patent: May 2, 2017

(54) UPGRADING HYDROCARBON PYROLYSIS PRODUCTS

(71) Applicant: ExxonMobil Chemical Patents Inc., Baytown, TX (US)

(72) Inventors: Christopher M. Evans, Houston, TX (US); Nikolaos Soultanidis, Houston, TX (US); Reyyan Koc-Karabocek, Houston, TX (US); David T. Ferrughelli, Flemington, NJ (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 83 days.

(21) Appl. No.: 14/683,482

(22) Filed: Apr. 10, 2015

(65) Prior Publication Data

US 2016/0122667 A1 May 5, 2016

Related U.S. Application Data

(60) Provisional application No. 62/072,114, filed on Oct. 29, 2014.

(30) Foreign Application Priority Data

Jan. 9, 2015 (EP) ..... 15150606

(51) Int. Cl.

| | |
|---|---|
| ***C10G 69/06*** | (2006.01) |
| ***C10G 9/36*** | (2006.01) |
| *C10G 69/00* | (2006.01) |

(52) U.S. Cl.
CPC ..... *C10G 69/06* (2013.01); *C10G 9/36* (2013.01); *C10G 2300/80* (2013.01)

(58) Field of Classification Search
CPC ..... C10G 69/00; C10G 69/06; C10G 9/36; C10G 2300/80; C10G 2300/807
See application file for complete search history.

(56) References Cited

U.S. PATENT DOCUMENTS

| | | | | |
|---|---|---|---|---|
| 5,158,668 | A | 10/1992 | Chahar et al. | |
| 5,871,634 | A * | 2/1999 | Wiehe | C10G 9/005 208/48 R |
| 6,632,351 | B1 | 10/2003 | Ngan et al. | |
| 7,090,765 | B2 | 8/2006 | Spicer et al. | |
| 7,097,758 | B2 | 8/2006 | Stell et al. | |

(Continued)

FOREIGN PATENT DOCUMENTS

| | | |
|---|---|---|
| WO | 2013/033575 | 3/2013 |
| WO | 2013/033577 | 3/2013 |

(Continued)

OTHER PUBLICATIONS

U.S. Appl. No. 61/986,316, filed Apr. 30, 20.
U.S. Appl. No. 62/015,036, filed Jun. 20, 2014.

*Primary Examiner* — Brian McCaig

(57) ABSTRACT

The invention relates to a process for upgrading pyrolysis tar, such as steam cracker tar, in the presence of a utility fluid. The utility fluid contains 2-ring and/or 3-ring aromatics and has solubility blending number ($S_{BN}$)≥120. The invention also relates to the upgraded pyrolysis tar and to the use of the upgraded pyrolysis tar, for example, for fuel oil blending.

11 Claims, 4 Drawing Sheets

(56) References Cited

U.S. PATENT DOCUMENTS

| | | | | |
|---|---|---|---|---|
| 7,138,047 | B2 | 11/2006 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 2006/0042661 | A1* | 3/2006 | Meyer | B08B 9/0933 134/22.14 |
| 2014/0061096 | A1* | 3/2014 | Brown | C10G 69/06 208/73 |
| 2014/0262947 | A1 | 9/2014 | Brown et al. | |

FOREIGN PATENT DOCUMENTS

| | | |
|---|---|---|
| WO | 2013/033580 | 3/2013 |
| WO | 2013/033582 | 3/2013 |
| WO | 2013/033590 | 3/2013 |

* cited by examiner

UPGRADING HYDROCARBON PYROLYSIS PRODUCTS

CROSS-REFERENCE TO RELATED APPLICATIONS

This application claims priority to and the benefit of application of U.S. Provisional Application Ser. No. 62/072,114, filed Oct. 29, 2014 and EP 15150606.0 filed Jan. 9, 2015, the entireties are incorporated herein by reference.

FIELD

The invention relates to a process for upgrading pyrolysis tar, such as steam cracker tar, to the upgraded pyrolysis tar, and to the use of the upgraded pyrolysis tar.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is steam cracking, the pyrolysis tar is identified as steam-cracker tar ("SCT").

Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane insoluble compounds and heptane-insoluble compounds. Particularly challenging pyrolysis tars contain >1 wt % toluene insoluble compounds. The high molecular weight compounds are typically multi-ring structures that are also referred to as tar heavies ("TH"). These high molecular weight molecules can be generated during the pyrolysis process, and their high molecular weight leads to high viscosity which limits desirable pyrolysis tar disposition options. For example, it is desirable to find higher-value uses for SCT, such as for fluxing with heavy hydrocarbons, especially heavy hydrocarbons of relatively high viscosity. It is also desirable to be able to blend SCT with one or more heavy oils, examples of which include bunker fuel, burner oil, heavy fuel oil (e.g., No. 5 or No. 6 fuel oil), high-sulfur fuel oil, low-sulfur oil, regular-sulfur fuel oil ("RSFO"), and the like.

One difficulty encountered when blending heavy hydrocarbons is fouling that results from precipitation of high molecular weight molecules, such as asphaltenes. See, e.g., U.S. Pat. No. 5,871,634, which is incorporated herein by reference in its entirety. In order to mitigate asphaltene precipitation, an Insolubility Number, $I_N$, and a Solvent Blend Number, $S_{BN}$, are determined for each blend component. Successful blending is accomplished with little or substantially no precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons. Pyrolysis tars having $I_N$>110, e.g., >130, are particularly difficult to blend.

Attempts at pyrolysis tar hydroprocessing to reduce viscosity and improve both $I_N$ and $S_{BN}$ have not led to a commercializable process, primarily because fouling of process equipment could not be substantially mitigated. For example, neat SCT hydroprocessing results in rapid catalyst coking when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This coking has been attributed to the presence of TH in the SCT that leads to the formation of undesirable deposits (e.g., coke deposits) on the hydroprocessing catalyst and the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

One approach taken to overcome these difficulties is disclosed in International Patent Application Publication No. WO 2013/033580, which is incorporated herein by reference in its entirety. The application discloses hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, and increased hydrogen content over that of the SCT feedstock, resulting in improved compatibility with fuel oil and blend-stocks. Additionally, efficiency advances involving recycling a portion of the upgraded pyrolysis tar product as utility fluid are described in International Patent Application Publication No. WO 2013/033590 incorporated herein by reference in its entirety.

Co-pending U.S. Patent Application No. 61/986,316 filed Apr. 30, 2014, which is incorporated herein by reference in its entirety, describes separating and recycling a mid-cut utility fluid from the upgraded pyrolysis tar product. The utility fluid comprises ≥10.0 wt % aromatic and non-aromatic ring compounds and each of the following: (a) ≥1.0 wt % of 1.0 ring class compounds; (b) ≥5.0 wt % of 1.5 ring class compounds; (c) ≥5.0 wt % of 2.0 ring class compounds; and (d)≤0.1 wt % of 5.0 ring class compounds.

Co-pending U.S. Patent Application No. 62/015,036 filed Jun. 20, 2014, which is incorporated herein by reference in its entirety, describes separating and recycling a utility fluid from the upgraded pyrolysis tar product. The utility fluid contains 1-ring and/or 2-ring aromatics and has a final boiling point ≤430° C.

While these references are advances toward developing a commercial process for converting pyrolysis tar to lower boiling more valued products, they have fallen short of this goal when the pyrolysis tar has $I_N$>110. The referenced processes experience reactor plugging that limits run length, e.g., less than 30 days, when processing pyrolysis tars having $I_N$>110. Therefore, a process is desired for hydroprocessing a broad range of pyrolysis tars over an extended period of time, e.g., >1 year, without reactor plugging. Further, it is also desired to have a pyrolysis tar hydroprocessing process with the ability to reverse or remove reactor plugging.

SUMMARY

When hydroprocessing pyrolysis tars having an incompatibility number ($I_N$)>110, it has been discovered that a beneficial decrease in reactor plugging can be achieved by using a utility fluid that has a solubility blending number ($S_{BN}$)≥120. Additionally, it has been discovered that there is a beneficial decrease in reactor plugging when hydroprocessing pyrolysis tars having incompatibility number ($I_N$)

≥110 if, after being combined, the utility fluid and tar mixture has a high solubility blending number ($S_{BN}$)≥150, ≥155, or ≥160.

Accordingly, certain aspects of the invention relate to a hydrocarbon conversion process, comprising several steps. First, provide a pyrolysis feedstock comprising ≥10.0 wt. % hydrocarbon based on the weight of the pyrolysis feedstock. Second, pyrolyze the pyrolysis feedstock to produce a pyrolysis effluent comprising pyrolysis tar and ≥1.0 wt. % of $C_2$ unsaturates, based on the weight of the pyrolysis effluent. Third, separate at least a portion of the tar from the pyrolysis effluent. The separated tar has $I_N$>110 and ≥90 wt. % of the pyrolysis effluent's molecules have an atmospheric boiling point of ≥290° C. Fourth, provide a utility fluid comprising ring aromatics in an amount ≥25.0 wt. % based on the weight of the utility fluid where the utility fluid has $S_{BN}$≥120. Fifth, combine at least a portion of the separated pyrolysis tar and utility fluid. Sixth, provide treat gas comprising molecular hydrogen. Seventh, hydroprocess the combined pyrolysis tar and utility fluid in a hydroprocessing zone in the presence of treat gas under catalytic hydroprocessing conditions to produce a hydroprocessed product. The hydroprocessed product comprises hydroprocessed tar.

Other aspects of the invention related to additional steps for providing a utility fluid. First, separate from the hydroprocessed product (i) an overhead stream, (ii) a bottoms stream, and (iii) a side stream where the side stream has $S_{BN}$≥120. Second, conduct at least a portion of the side stream to be used as utility fluid where the utility fluid comprises ≥10.0 wt. % of the side stream, based on the weight of the utility fluid.

Yet other aspects of the invention relate alternative steps for providing a utility fluid. First, separate from the hydroprocessed product (i) an overhead stream, (ii) a bottoms stream, and (iii) a mid-cut stream. Second, combine at least a portion of the mid-cut stream with at least a portion of the bottoms stream to form a heavy mid-cut stream so the heavy mid-cut stream has $S_{BN}$≥120. Third, conducting at least a portion of the heavy mid-cut stream to be used as utility fluid where the utility fluid comprises ≥10.0 wt. % of the heavy mid-cut stream, based on the weight of the utility fluid.

These and other features, aspects, and advantages of the present invention will become better understood from the following description, appended claims, and accompanying drawings.

BRIEF DESCRIPTION OF THE DRAWINGS

The drawings are for illustrative purposes only and are not intended to limit the scope of the present invention.

DETAILED DESCRIPTION

Figure 1:
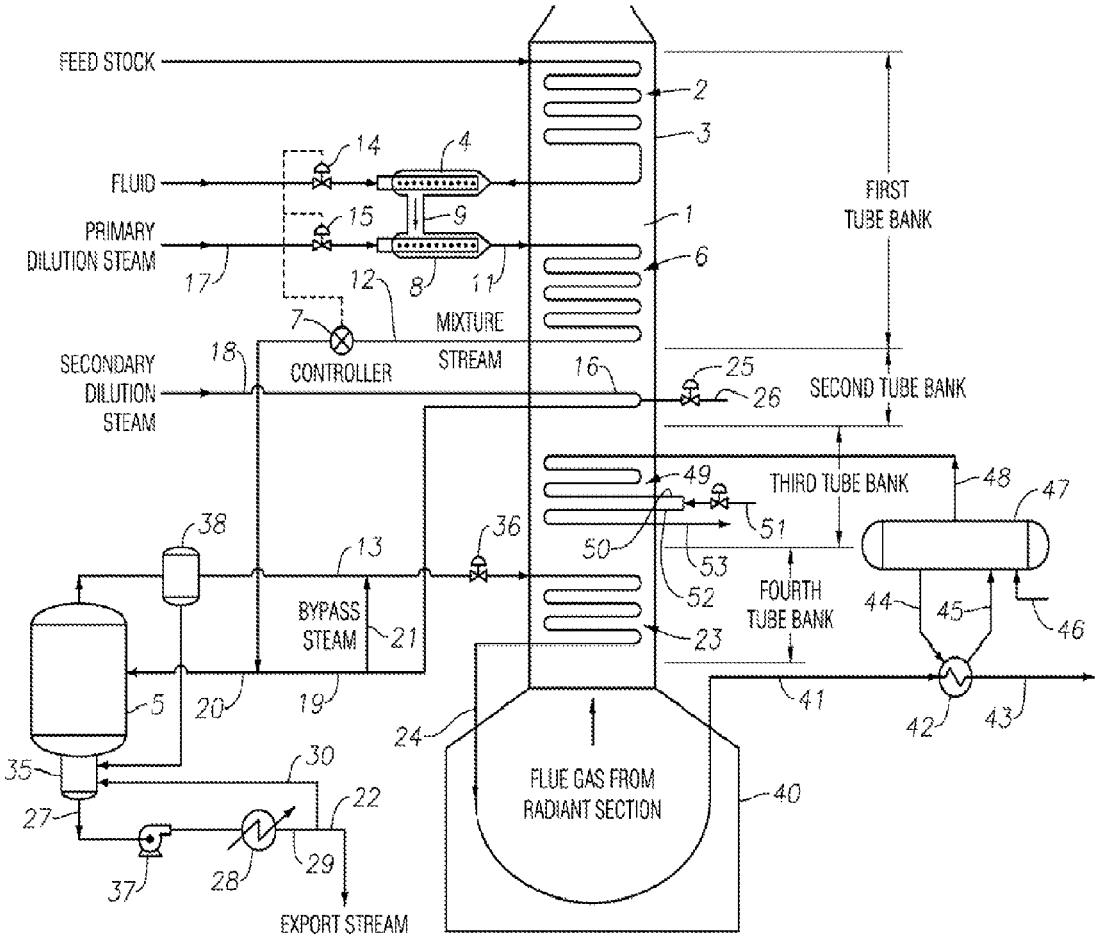
FIG. 1 schematically illustrates a hydrocarbon pyrolysis process.

Certain aspects of the invention relate to hydroprocessing a pyrolysis tar in the presence of a utility fluid. It has been discovered that there is a beneficial decrease in reactor plugging when hydroprocessing pyrolysis tars having incompatibility number ($I_N$)>110 if the utility fluid has a high solubility blending number ($S_{BN}$), for example, $S_{BN}$≥120, ≥125, or ≥130. Additionally, it has been discovered that there is a beneficial decrease in reactor plugging when hydroprocessing pyrolysis tars having incompatibility number ($I_N$)>110 if, after being combined, the utility fluid and tar mixture has a high solubility blending number ($S_{BN}$)≥150, ≥155, or ≥160.

While not wishing to be bound by any theory or model, it is believed the high incompatibility number $I_N$ molecules in some pyrolysis tars are incapable of being solubilized in utility fluid having lower $S_{BN}$. It has been observed that higher boiling point molecules in the hydroprocessed tar have higher solubility blending numbers ($S_{BN}$). By selecting higher boiling point molecules from the hydroprocessed tar, a utility fluid having higher $S_{BN}$ and decreased hydroprocessing reactor plugging may be achieved.

Generally, the utility fluid largely comprises a mixture of multi-ring compounds. The rings can be aromatic or non-aromatic and can contain a variety of substituents and/or heteroatoms. For example, the utility fluid can contain ≥40.0 wt %, ≥45.0 wt %, ≥50.0 wt %, ≥55.0 wt %, or ≥60.0 wt %., based on the weight of the utility fluid, of aromatic and non-aromatic ring compounds. Preferably, the utility fluid comprises aromatics. More preferably, the utility fluid comprises ≥25.0 wt %, ≥40.0 wt %, ≥50.0 wt %, ≥55.0 wt %, or ≥60.0 wt % aromatics, based on the weight of the utility fluid.

Typically, the utility fluid comprises one, two, and three ring aromatics. Preferably the utility fluid comprises ≥25.0 wt %, ≥40.0 wt %, ≥50.0 wt %, ≥55.0 wt %, or ≥60.0 wt % 2-ring and/or 3-ring aromatics, based on the weight of the utility fluid. The 2-ring and 3-ring aromatics are preferred due to their higher $S_{BN}$.

The utility fluid has a true boiling point distribution having an initial boiling point ≥177° C. (350° F.) and a final boiling point ≤566° C. (1050° F.). The utility fluid can have a true boiling point distribution having an initial boiling point ≥177° C. (350° F.) and a final boiling point ≤430° C. (800° F.). True boiling point distributions ("TBP", the distribution at atmospheric pressure) can be determined, e.g., by conventional methods such as the method of ASTM D7500. When the final boiling point is greater than that specified in the standard, the true boiling point distribution can be determined by extrapolation.

Since it is believed that the increased non-aromatic content of utility fluids having a relatively low initial boiling point, such as those where ≥10 wt. % of the utility fluid has an atmospheric boiling point ≤175° C., can lead to tar-utility fluid incompatibility and asphaltene precipitation, the utility fluid has a true initial boiling point ≥177° C. Likewise, since it is believed that higher SBN molecules are required to avoid incompatibility with high $I_N$ tars and higher boiling point molecules have higher SBN, the utility fluid has a true final boiling point ≤566° C. (1050° F.). Optionally, the utility fluid can have a true final boiling point >430° C. (800° F.). Such utility fluids have more than the desired minimum aromatic content (≥25.0 wt. % of 2 and 3-ring aromatics, based on the weight of the utility fluid).

Pyrolysis tar can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising ≥10.0 wt. % hydrocarbon, based on the weight of the feed, is subjected to pyrolysis, the pyrolysis effluent generally contains pyrolysis tar and ≥1.0 wt. % of $C_2$ unsaturates, based on the weight of the pyrolysis effluent. The pyrolysis tar generally comprises ≥90 wt. % of the pyrolysis effluent's molecules having an atmospheric boiling point of ≥290° C. Besides hydrocarbon, the feed to pyrolysis optionally further comprise diluent, e.g., one or more of nitrogen, water, etc. For example, the feed may further comprise ≥1.0 wt. % diluent based on the weight of the feed, such as ≥25.0 wt. %. When the diluent includes an appreciable amount of steam, the pyrolysis is referred to as steam cracking. For the purpose of this description and appended claims, the following terms are defined:

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a number of carbon atoms ≥about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane: SCT at 25.0° C. TH generally include asphaltenes and other high molecular weight molecules.

Aspects of the invention which include producing SCT by steam cracking will now be described in more detail. The invention is not limited to these aspects, and this description is not meant to foreclose other aspects within the broader scope of the invention, such as those which do not include steam cracking.

Obtaining Pyrolysis Tar by Steam Cracking

Conventional steam cracking utilizes a pyrolysis furnace which has two main sections: a convection section and a radiant section. The pyrolysis feedstock typically enters the convection section of the furnace where the pyrolysis feedstock's hydrocarbon is heated and vaporized by indirect contact with hot flue gas from the radiant section and by direct contact with the pyrolysis feedstock's steam. The vaporized pyrolysis feedstock is then introduced into the radiant section where ≥50% (weight basis) of the cracking takes place. A pyrolysis effluent is conducted away from the pyrolysis furnace, the pyrolysis effluent comprising products resulting from the pyrolysis of the pyrolysis feedstock and any unconverted components of the pyrolysis feedstock. At least one separation stage is generally located downstream of the pyrolysis furnace, the separation stage being utilized for separating from the pyrolysis effluent one or more of light olefin, SCN, SCGO, SCT, water, unreacted hydrocarbon components of the pyrolysis feedstock, etc. The separation stage can comprise, e.g., a primary fractionator. Generally, a cooling stage is located between the pyrolysis furnace and the separation stage. Conventional cooling means can be utilized by the cooling stage, e.g., one or more of direct quench and/or indirect heat exchange, but the invention is not limited thereto.

In certain aspects, the pyrolysis tar is SCT produced in one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising ≥90.0 wt. % SCT, based on the weight of the bottoms stream. The SCT can have, e.g., a boiling range ≥about 550° F. (290° C.) and can comprise molecules and mixtures thereof having a number of carbon atoms ≥about 15.

The pyrolysis feedstock typically comprises hydrocarbon and steam. In certain aspects, the pyrolysis feedstock comprises ≥10.0 wt. % hydrocarbon, based on the weight of the pyrolysis feedstock, e.g., ≥25.0 wt. %, ≥50.0 wt. %, such as ≥0.65 wt. %. Although the pyrolysis feedstock's hydrocarbon can comprise one or more of light hydrocarbons such as methane, ethane, propane, butane etc., it can be particularly advantageous to utilize the invention in connection with a pyrolysis feedstock comprising a significant amount of higher molecular weight hydrocarbons because the pyrolysis of these molecules generally results in more SCT than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain aspects, the pyrolysis feedstock's hydrocarbon comprises ≥5 wt. % of non-volatile components, based on the weight of the hydrocarbon portion, e.g., ≥30 wt. %, such as ≥40 wt. %, or in the range of 5 wt. % to 50 wt. %. Non-volatile components are the fraction of the hydrocarbon feed with a nominal boiling point above 1100° F. (590° C.) as measured by ASTM D-6352-98, D-7580. These ASTM methods can be extrapolated, e.g., when a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The pyrolysis feedstock's hydrocarbon can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 weight percent of a particular sample has reached its boiling point.

In certain aspects, the pyrolysis feedstock's hydrocarbon comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil and followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the pyrolysis feedstock's hydrocarbon comprises sulfur, e.g., ≥0.1 wt. % sulfur based on the weight of the pyrolysis feedstock's hydrocarbon, e.g., ≥1.0 wt. %, such as in the range of about 1.0 wt. % to about 5.0 wt. %. Optionally, at least a portion of the pyrolysis feedstock's sulfur-containing molecules, e.g., ≥10.0 wt. % of the pyrolysis feedstock's sulfur-containing molecules, contain at least one aromatic ring ("aromatic sulfur"). When (i) the pyrolysis feedstock's hydrocarbon is a crude oil or crude oil fraction comprising ≥0.1 wt. % of aromatic sulfur and (ii) the pyrolysis is steam cracking, then the SCT contains a significant amount of sulfur derived from the pyrolysis feedstock's aromatic sulfur. For example, the SCT sulfur content can be about 3 to 4 times higher in the SCT than in the pyrolysis feedstock's hydrocarbon component, on a weight basis.

It has been found that including sulfur and/or sulfur-containing molecules in the pyrolysis feedstock lessens the amount of olefinic unsaturation (and the total amount of olefin) present in the SCT. For example, when the pyrolysis feedstock's hydrocarbon comprises sulfur, e.g., ≥0.1 wt. % sulfur based on the weight of the pyrolysis feedstock's hydrocarbon, e.g., ≥1.0 wt. %, such as in the range of about 1.0 wt. % to about 5.0 wt. %, then the amount of olefin contained in the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because the presence of feed sulfur leads to an increase in amount of sulfur-containing hydrocarbon molecules in the pyrolysis effluent. Such sulfur-containing molecules can include, for example, one or more of mercaptans; thiophenols; thioethers, such as heterocyclic thioethers (e.g., dibenzosulfide; thiophenes, such as benzothiophene and dibenzothiophene; etc. The formation of these sulfur-containing hydrocarbon molecules is believed to lessen the amount of amount of relatively high molecular weight olefinic molecules (e.g., $C_{6+}$ olefin) produced during and after the pyrolysis, which results in fewer vinyl aromatic molecules available for inclusion in SCT, e.g., among the SCT's TH aggregates. In other words, when the pyrolysis feedstock includes sulfur, the pyrolysis favors the formation in the SCT of sulfur-containing hydrocarbon, such as $C_{6+}$ mercaptan, over $C_{6+}$ olefins such as vinyl aromatics.

In certain aspects, the pyrolysis feedstock comprises steam in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the pyrolysis feedstock comprises hydrocarbon and diluent, wherein;

a. the pyrolysis feedstock's hydrocarbon comprises ≥50.0 wt. % based on the weight of the pyrolysis feedstock's hydrocarbon of one or more of one or more crude oils and/or one or more crude oil fractions, such as those obtained from an APS and/or VPS; waxy residues: atmospheric residues; naphthas contaminated with crude; various residue admixtures; and SCT; and
b. the pyrolysis feedstock's diluent comprises, e.g., ≥95.0 wt. % water based on the weight of the diluent, wherein the amount of diluent in the pyrolysis feedstock is in the range of from about 10.0 wt. % to 90.0 wt. %, based on the weight of the pyrolysis feedstock.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A pyrolysis effluent is conducted away from the pyrolysis furnace, the pyrolysis effluent being derived from the pyrolysis feedstock by the pyrolysis. When utilizing the specified pyrolysis feedstock and pyrolysis conditions of any of the preceding aspects, the pyrolysis effluent generally comprises ≥1.0 wt. % of $C_2$ unsaturates and ≥0.1 wt. % of TH, the weight percents being based on the weight of the pyrolysis effluent. Optionally, the pyrolysis effluent comprises ≥5.0 wt. % of $C_2$ unsaturates and/or ≥0.5 wt. % of TH, such as ≥1.0 wt. % TH. Although the pyrolysis effluent generally contains a mixture of the desired light olefins, SCN, SCGO, SCT, and unreacted components of the pyrolysis feedstock (e.g., water in the case of steam cracking, but also in some cases unreacted hydrocarbon), the relative amount of each of these generally depends on, e.g., the pyrolysis feedstock's composition, pyrolysis furnace configuration, process conditions during the pyrolysis, etc. The pyrolysis effluent is generally conducted away for the pyrolysis section, e.g., for cooling and separation.

In certain aspects, the pyrolysis effluent's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the pyrolysis effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the pyrolysis effluent downstream of the pyrolysis furnace, e.g., the pyrolysis effluent can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the pyrolysis effluent can be subjected to direct quench at a point typically between the furnace outlet and the separation stage. The quench can be accomplished by contacting the pyrolysis effluent with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench fluids include liquid quench oil, such as those obtained by a downstream quench oil knock-out drum, pyrolysis fuel oil and water, which can be obtained from conventional sources, e.g., condensed dilution steam.

A separation stage can be utilized downstream of the pyrolysis furnace and downstream of the transfer line exchanger and/or quench point for separating from the pyrolysis effluent one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating an SCT-containing tar stream (the "tar stream") from the pyrolysis effluent. The tar stream typically contains ≥90.0 wt. % of SCT based on the weight of the tar stream, e.g., ≥95.0 wt. %, such as ≥99.0 wt. %, with the balance of the tar stream being particulates, for example. The tar stream's SCT generally comprises ≥10.0% (on a weight basis) of the pyrolysis effluent's TH. The tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In certain aspects, the SCT comprises ≥50.0 wt. % of the pyrolysis effluent's TH based on the weight of the pyrolysis effluent's TH. For example, the SCT can comprise ≥90.0 wt. % of the pyrolysis effluent's TH based on the weight of the pyrolysis effluent's TH. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.15 g/cm$^3$, e.g., in the range of 1.07 g/cm$^3$ to 1.15 g/cm$^3$; and (iv) a 50° C. viscosity in the range of 200 cSt to $1.0\times10^7$ cSt. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is generally ≤5.0 wt. %, e.g., ≤3 wt. %, such as ≤2.0 wt. %, based on the weight of the SCT.

Vapor-Liquid Separator

Optionally, the pyrolysis furnace has at least one vapor/liquid separation device (sometimes referred to as flash pot or flash drum) integrated therewith. The vapor-liquid separator is utilized for upgrading the pyrolysis feedstock before exposing it to pyrolysis conditions in the furnace's radiant section. It can be desirable to integrate a vapor-liquid separator with the pyrolysis furnace when the pyrolysis feedstock's hydrocarbon comprises ≥1.0 wt. % of non-volatiles, e.g., ≥5.0 wt. %, such as 5.0 wt. % to 50.0 wt. % of non-volatiles having a nominal boiling point ≥1400° F. (760° C.). The boiling point distribution and nominal boiling points of the pyrolysis feedstock's hydrocarbon are measured by Gas Chromatograph Distillation (GCD) according to the methods described in ASTM D-6352-98 or D-2887, extended by extrapolation for materials having a boiling point at atmospheric pressure ("atmospheric boiling point) ≥700° C. (1292° F.). It is particularly desirable to integrate a vapor/liquid separator with the pyrolysis furnace when the non-volatiles comprise asphaltenes, such as pyrolysis feedstock's hydrocarbon comprises ≥about 0.1 wt. % asphaltenes based on the weight of the pyrolysis feedstock's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the device is substantially the same as the composition of the liquid phase entering the device, i.e., the separation in the vapor/liquid separation device includes (or even consists essentially of) a physical separation of the two phases entering the device.

In aspects which include integrating a vapor/liquid separation device with the pyrolysis furnace, at least a portion of the pyrolysis feedstock's hydrocarbon is provided to the inlet of a convection section of a pyrolysis unit, wherein hydrocarbon is heated so that at least a portion of the hydrocarbon is in the vapor phase. When a diluent (e.g., steam) is utilized, the pyrolysis feedstock's diluent is optionally (but preferably) added in this section and mixed with the hydrocarbon to produce the pyrolysis feedstock. The pyrolysis feedstock, at least a portion of which is in the vapor phase, is then flashed in at least one vapor/liquid separation device in order to separate and conduct away from the pyrolysis feedstock at least a portion of the pyrolysis feedstock's non-volatiles, e.g., high molecular-weight non-volatile molecules, such as asphaltenes. A bottoms fraction can be conducted away from the vapor-liquid separation device, the bottoms fraction comprising, e.g., ≥10.0% (on a wt. basis) of the pyrolysis feedstock's non-volatiles, such as ≥10.0% (on a wt. basis) of the pyrolysis feedstock's asphaltenes.

One of the advantages obtained when utilizing an integrated vapor-liquid separator is the lessening of the amount of $C_{6+}$ olefin in the SCT, particularly for when the pyrolysis feedstock's hydrocarbon has a relatively high asphaltene content and a relatively low sulfur content. Such hydrocarbons include, for example, those having (i) ≥about 0.1 wt. % asphaltenes based on the weight of the pyrolysis feedstock's hydrocarbon component, e.g., ≥about 5.0 wt. %; (ii) a final boiling point ≥600° F. (315° C.), generally ≥950° F. (510° C.), or ≥1100° F. (590° C.), or ≥1400° F. (760° C.); and optionally (iii) ≤5 wt. % sulfur, e.g., ≤1.0 wt sulfur, such as ≤0.1 wt. % sulfur. It is observed that utilizing an integrated vapor-liquid separator when pyrolysing these hydrocarbons in the presence of steam, the amount of olefin the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because precursors in the pyrolysis feedstock's hydrocarbon that would otherwise form $C_{6+}$ olefin in the SCT are separated from the pyrolysis feedstock in the vapor-liquid separator and conducted away from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolysed utilizing an integrated vapor-liquid separator operating under the specified conditions, the SCT density is increased, e.g., to an API gravity ≤−7.5° API, such as ≤−8.0° API, or ≤−8.5° API.

Another advantage obtained when utilizing a vapor/liquid separator integrated with the pyrolysis furnace is that it increases the range of hydrocarbon types available to be used directly, without pretreatment, as hydrocarbon components in the pyrolysis feedstock. For example, the pyrolysis feedstock's hydrocarbon component can comprise ≥50.0 wt. %, e.g., ≥75.0 wt. %, such as ≥90.0 wt. % (based on the weight of the pyrolysis feedstock's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separation device is integrated with the pyrolysis furnace. If desired, the pyrolysis feedstock's composition can vary over time, e.g., by utilizing a pyrolysis feedstock having a first hydrocarbon during a first time period and then, during a second time period, substituting for at least a portion of the first hydrocarbon a second hydrocarbon. The first and second hydrocarbons can be substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be blended under ambient conditions). For example, the pyrolysis feedstock can comprise a first hydrocarbon during a first time period and a second hydrocarbon (one that is substantially incompatible with the first hydrocarbon) during a second time period. The first hydrocarbon can comprise, e.g., a virgin crude oil. The second hydrocarbon can comprise SCT.

In certain aspects a pyrolysis furnace is integrated with a vapor-liquid separator device as illustrated schematically in FIG. 1. A hydrocarbon feedstock or feed is introduced into furnace 1 via an entry line (labeled but not numbered), the hydrocarbon feed being heated by indirect contact with hot flue gasses in the upper region (not numbered) farthest from the radiant section 40 of the convection section 3. The heating is accomplished by passing at least a portion of the hydrocarbon feed through a bank of heat exchange tubes 2 located within the convection section 3 of the furnace 1. The heated hydrocarbon feed typically has a temperature in the range of about 300° F. to about 500° F. (150° C. to 260° C.), such as about 325° F. to about 450° F. (160° C. to 230° C.), for example about 340° F. to about 425° F. (170° C. to 220° C.). Diluent, in this case primary dilution steam, is introduced via line 17 and is combined with the heated hydrocarbon feed in sparger 8 and double sparger 9. Additional fluid, such as one or more of additional hydrocarbon, steam, and water, such as boiler feed water, can be introduced into the heated hydrocarbon via sparger 4. Generally, the primary dilution steam stream is injected into the pyrolysis hydrocarbon feed before the combined hydrocarbon-steam mixture (the pyrolysis feedstock) enters the convection section at 11, for additional heating by flue gas. The primary dilution steam generally has a temperature greater than that of the pyrolysis feedstock's hydrocarbon, in order to at least partially vaporize the pyrolysis feedstock's hydrocarbon. The pyrolysis feedstock is heated again in the convection section of the pyrolysis furnace 3 before the vapor-liquid separation, e.g., by passing the pyrolysis feedstock through a bank of heat exchange tubes 6. The pyrolysis feedstock leaves the convection section as a re-heated pyrolysis feedstock 12. An optional secondary dilution steam stream can be introduced via line 18. If desired, the re-heated pyrolysis feedstock 12 can be further heated by combining it with the secondary dilution steam upstream of vapor-liquid separation. Optionally, the secondary dilution steam is split into (i) a flash steam stream 19 for mixing with the re-heated pyrolysis feedstock 12 before vapor-liquid separation and (ii) a bypass steam stream 21. The bypass steam bypasses the vapor-liquid separation and is instead mixed with a vapor phase that is separated from the re-heated pyrolysis feedstock 12 in the vapor-liquid separator. The mixing is carried out before the vapor phase is cracked in the radiant section of the furnace. Alternatively, the secondary dilution steam 18 is directed to bypass steam stream 21 with no flash steam stream 19. In certain aspects, the ratio of the flash steam stream 19 to bypass steam stream 21 is 1:20 to 20:1, e.g., 1:2 to 2:1. The flash steam stream 19 is then mixed with the re-heated pyrolysis feedstock 12 to form a flash stream 20 before the flash in vapor-liquid separator 5. Optionally, the secondary dilution steam stream is superheated in a superheater section 16 in the furnace convection before splitting and mixing with the heavy hydrocarbon mixture. The addition of the flash steam stream 19 to the pyrolysis feedstock 12 aids the vaporization of most volatile components of the pyrolysis feedstock before the flash stream 20 enters the vapor-liquid separation vessel 5. The pyrolysis feedstock 12 or the flash stream 20 is then flashed, for separation of two phases: a vapor phase comprising predominantly volatile hydrocarbons and steam, and a liquid phase comprising predominantly non-volatile hydrocarbons. The vapor phase is preferably removed from vessel 5 as an overhead vapor stream 13. The vapor phase can be transferred to a convection section tube bank 23 of the furnace, e.g., at a location proximate to the radiant section of the furnace, for optional heating and through crossover pipes 24 to the radiant section 40 of the pyrolysis furnace for cracking. The liquid phase of the flashed mixture stream is removed from vessel 5 as a bottoms stream 27.

Typically, the temperature of the pyrolysis feedstock 12 can be set and controlled in the range of about 600° F. to about 1000° F. (315° C. to 540° C.), in response, to changes of the concentration of volatiles in the pyrolysis feedstock. The temperature can be selected to maintain a liquid phase in line 12 and downstream thereof to reduce the likelihood of coke formation on exchanger tube walls and in the vapor-liquid separator. The pyrolysis feedstock's temperature can be controlled by a control system 7, which generally includes a temperature sensor and a control device, which can be automated by way of a computer. The control system 7 communicates with the fluid valve 14 and the primary dilution steam valve 15 in order to regulate the amount of fluid and primary dilution steam entering dual sparger 9. An intermediate desuperheater 25 can be utilized, e.g., to further avoid sharp variation of the flash temperature. After partial preheating, the secondary dilution steam exits the convection section and a fine mist of desuperheater water 26 is added, which rapidly vaporizes and reduces the steam temperature. This allows the superheater 16 outlet temperature to be controlled at a constant value, independent of furnace load changes, coking extent changes, excess oxygen level changes, and other variables. When used, desuperheater 25 generally maintains the temperature of the secondary dilution steam in the range of about 800° F. to about 1100° F. (425° C. to 590° C.) in addition to maintaining a substantially constant temperature of the mixture stream 12 entering the flash/separator vessel, it is generally also desirable to maintain a constant hydrocarbon partial pressure of the flash stream 20 in order to maintain a substantially constant ratio of vapor to liquid in the flash/separator vessel. By way of examples, a substantially constant hydrocarbon partial pressure can be maintained through the use of control valve 36 on the vapor phase line 13 and by controlling the ratio of steam to hydrocarbon pyrolysis feedstock in stream 20. Typically, the hydrocarbon partial pressure of the flash stream in the present invention is set and controlled in a range of about 4 psia to about 25 psia (25 kPa to 175 kPa), such as in a range of about 5 psia to about 15 psia (35 kPa to 100 kPa), for example in a range of about 6 psia to about 11 psia (40 kPa to 75 kPa).

Conventional vapor-liquid separation conditions can be utilized in vapor-liquid separator 5, such as those disclosed in U.S. Pat. No. 7,820,035. When the pyrolysis feedstock's hydrocarbon component comprises one or more crude oil or fractions thereof, the vapor/liquid separation device can operate at a temperature in the range of from about 600° F. to about 950° F. (about 350° C. to about 510° C.) and a pressure in the range of about 275 kPa to about 1400 kPa, e.g., a temperature in the range of from about 430° C. to about 480° C. and a pressure in the range of about 700 kPa to 760 kPa. A vapor phase conducted away from the vapor/liquid separation device can be subjected to further heating in the convection section, as shown in the figure. The re-heated vapor phase is then introduced via crossover piping into the radiant section where the overheads are exposed to a temperature ≥760° C. at a pressure ≥0.5 bar (gauge) e.g., a temperature in the range of about 790° C. to about 850° C. and a pressure in the range of about 0.6 bar (gauge) to about 2.0 bar (gauge), to carry out the pyrolysis (e.g., cracking and/or reforming).

Accordingly, vapor portion of the pyrolysis feedstock is conducted away from vapor-liquid separator 5 via line 13 and valve 36 for cracking in radiant section 40 of the pyrolysis furnace. A liquid portion of the pyrolysis feedstock is conducted away from vapor-liquid separator 5 vial line 27. Stream 27 can be conveyed from the bottom of the flash/separator vessel 5 to the cooler 28 via pump 37. The cooled stream 29 can then be split into a recycle stream 30 and an export stream 22. Recycle liquid in line 30 can be returned to drum 5 proximate to bottom section 35. The vapor phase may contain, for example, about 55% to about 70% hydrocarbon (by weight) and about 30% to about 45% steam (by weight). The final boiling point of the vapor phase is generally 1400° F. (760° C.), such as ≤1100° F. (590° C.), for example below about 1050° F. (565° C.), or ≤about 1000° F. (540° C.). An optional centrifugal separator 38 can be used for removing from the vapor phase any entrained and/or condensed liquid. The vapor then returned to the furnace via a manifold that distributes the flow to the lower convection section 23 for heating, e.g., to a temperature in the range of about 800° F. to about 1300° F. (425° C. to 705° C.). The vapor phase is then introduced to the radiant section of the pyrolysis furnace to be cracked, optionally after mixing with bypass steam stream 21.

The radiant section's effluent can be rapidly cooled in a transfer-line exchanger 42 via line 41, Indirect cooling can be used, e.g., using water from a steam drum 47, via lines 44 and 45, in a thermosyphon arrangement, Water can be added via line 46. The saturated steam 48 conducted away from the drum can be superheated in the high pressure steam superheater bank 49. The desupetheater can include a control valve/water atomizer nozzle 51, line 50 for transferring steam to the desuperheater, and line 52 for transferring steam away from the desuperheater. After partial heating, the high pressure steam exits the convection section via line 50 and water from 51 is added (e.g., as a fine mist) which rapidly vaporizes and reduces the temperature. The high pressure steam can be returned to the convection section via line 52 for further heating. The amount of water added to the superheater can control the temperature of the steam withdrawn via line 53.

After cooling in transfer-line exchanger 42, the pyrolysis effluent is conducted away via line 43, e.g., for separating from the pyrolysis effluent one or more of molecular hydrogen, water, unconverted feed, SCT, gas oils, pyrolysis gasoline, ethylene, propylene, and $C_4$ olefin.

In aspects where a vapor-liquid separator is integrated with the pyrolysis furnace, the SCT generally comprises ≥50.0 wt. % of the pyrolysis effluent's TH based on the weight of the pyrolysis effluent's TH, such as ≥90.0 wt. %. For example, the SCT can have (i) a TH content in the range of from 5.0 wt. % to 40.0 wt. %, based on the weight of the SCT; (ii) an API gravity (measured at a temperature of 15.8° C.) of ≤−7.5° API, such as ≤−8.0° API, or ≤−8.5° API; and (iii) a 50° C. viscosity in the range of 200 cSt to $1.0\times10^7$ cSt. The SCT can have, e.g., a sulfur content that is >0.5 wt. %, e.g., in the range of 0.5 wt. % to 7.0 wt. %. In aspects where pyrolysis feedstock does not contain an appreciable amount of sulfur, the SCT can comprise ≤0.5 wt. % sulfur, based on the weight of the SCT, e.g., ≤0.1 wt. %, such as ≤0.05 wt. %. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT is generally ≤5.0 wt. aggregates in the SCT which incorporate vinyl aromatics is generally ≤5.0 wt. %, e.g., ≤3 wt. %, such as ≤2.0 wt. %, the weight percents being based on the weight of the SCT.

Generally, SCT has high solubility blending number values, for example, $S_{BN}$>135, and high incompatibility number, for example, $I_N$≥80, making them difficult to blend with other heavy hydrocarbons. In aspects where a vapor-liquid separator is integrated with the pyrolysis furnace, it has been observed that SCT has even higher $S_{BN}$ and $I_N$ making these SCT particularly difficult to blend and hydroprocess. For example, SCT can have $S_{BN}$>170 or $S_{BN}$>200. SCT can have $I_N$>110, >120, or $I_N$>130.

Aspects of the invention relating to SCT hydroprocessing will now be described in more detail. The invention is not limited to SCT hydroprocessing, and this description is not meant to foreclose other aspects within the broader scope of the invention, such as those in which include hydroprocessing other kinds of pyrolysis tar.

Hydroprocessing SCT

Figure 2:
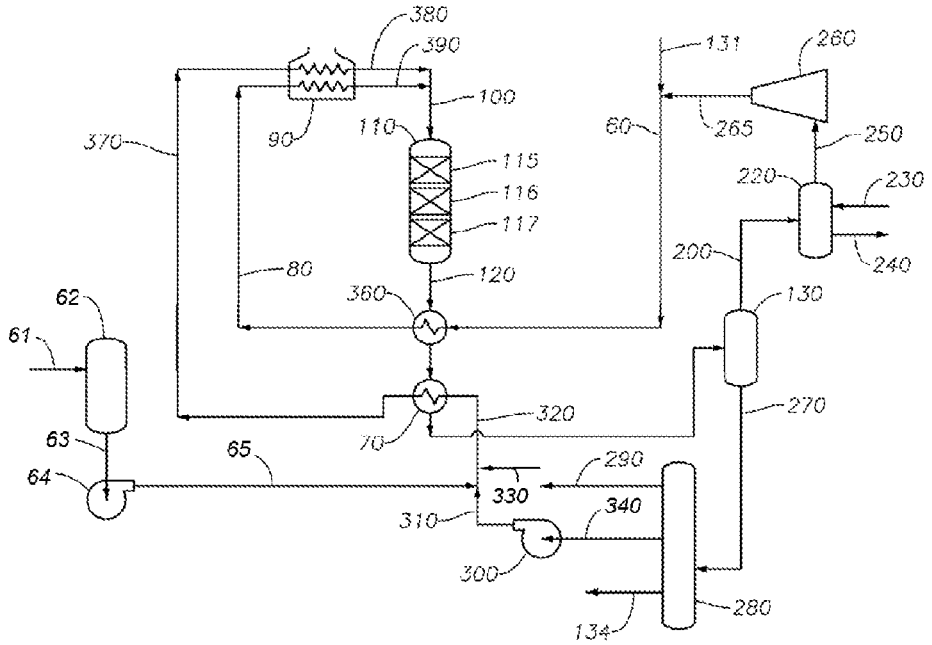
FIGS. 2 and 3 schematically illustrate a pyrolysis tar hydroprocessing process.

Referring to FIG. 2, a tar stream containing SCT and having $I_N$>110 is conducted via conduit 61 to separation stage 62 for separation of SCT and one or more light gases and/or particulates from the tar stream. The SCT is conducted via conduit 63 to pump 64 to increase the SCT's pressure, the higher-pressure SCT being conducted away via conduit 65. A utility fluid conducted via line 310 is combined with the SCT of line 65, with the tar-fluid mixture being conducted to a tar-fluid mixture pre-heater stage 70 via conduit 320. The utility fluid is utilized during SCT hydroprocessing e.g., for effectively increasing run-length during hydroprocessing and improving SCT properties. Optionally, a supplemental utility fluid, may be added via conduit 330. The combined stream, a tar-fluid mixture which is primarily in liquid phase, is conducted to a supplemental pre-heat stage 90 via conduit 370. The supplemental pre-heat stage can be, e.g., a fired heater. Recycled treat gas is obtained from conduit 265. If needed, fresh treat gas, comprising molecular hydrogen, can be obtained from conduit 131. The treat gas is conducted via conduit 60 to a second pre-heat stage 360, the heated treat gas being conducted to the supplemental pre-heat stage 90 via conduit 80.

The pre-heated tar-fluid mixture (from line 380) is combined with the pre-heated treat gas (from line 390) and then conducted via line 100 to hydroprocessing stage 110. Mixing means are utilized for combining the pre-heated tar-fluid mixture with the pre-heated treat gas in hydroprocessing stage 110, e.g., one or more gas-liquid distributors of the type conventionally utilized in fixed bed reactors. The SCT is hydroprocessed in the presence of the utility fluid, supplemental utility fluid, the treat gas, and hydroprocessing catalyst in at least one catalyst bed 115. Additional catalyst beds, e.g., 116, 117, etc., with optional intercooling quench using treat gas, from conduit 60 provided between beds (not shown).

The hydroprocessed effluent is conducted away from stage 110 via conduit 120. When the tar-fluid mixture preheat stage 70 and the treat gas preheater stage 360 are heat exchangers, the heat transfer is indirect. Following these stages, the hydroprocessed effluent is conducted to separation stage 130 for separating total vapor product (e.g., heteroatom vapor, vapor-phase cracked products, unused treat gas, etc.) and hydroprocessed product (e.g., liquid phase hydroprocessed tar) from the hydroprocessed effluent. The total vapor product is conducted via line 200 to upgrading stage 220, which comprises, e.g., one or more amine towers. Fresh amine is conducted to stage 220 via line 230, with rich amine conducted away via line 240. Upgraded treat gas is conducted away from stage 220 via line 250, compressed in compressor 260, and conducted via line 265, 60, and 80 for re-cycle and re-use in the hydroprocessing stage 110. Fresh treat gas, e.g., for starting up the process or for make-up, is obtained from line 131.

The hydroprocessed product of stage 130 can be desirable as a diluent (e.g., a flux) for heavy hydrocarbons, especially those of relatively high viscosity. Optionally, all or a portion of the hydroprocessed product can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like.

The hydroprocessed product of stage 130, is conducted via line 270 to separation stage 280. Separation stage 280 may be, for example, a distillation column with side-stream draw although other conventional separation methods may be utilized. The hydroprocessed product is separated into an overhead stream, a side stream and a bottoms stream, listed in order of increasing boiling point, in separation stage 280. The overhead stream is conducted away from separation stage 280 via line 290. The bottoms stream is conducted away via line 134. The overhead and bottoms streams may be carried away for further processing. If desired, at least a portion of the bottoms can be utilized within the process and/or conducted away for storage or further processing. The bottoms portion of the hydroprocessed product can be desirable as a diluent (e.g., a flux) for heavy hydrocarbons as described above. Optionally, trim molecules may be separated, for example, in a fractionator (not shown), from bottoms or overhead or both and added to the side stream as desired. The side stream is carried away from separation stage 280 via conduit 20. At least a portion of the side stream 20 is utilized as utility fluid and conducted via pump 300 and conduit 310. The utility fluid comprises ≥10 wt. % of the side stream, based on the weight of the utility fluid.

Preferably, the operation of separation stage 280 is adjusted to shift the boiling point distribution of side stream 20 so that side stream 20 has properties desired for utility fluid. Side stream 20 can have a true boiling point distribution having an initial boiling point ≥177° C. (350° F.) and a final boiling point ≤566° C. (1050° F.). The side stream can also have a true boiling point distribution having an initial boiling point ≥177° C. (350° F.) and a final boiling point ≤430° C. (800° F.). The side stream can have $S_{BN}$≥120, ≥125, or ≥130.

Figure 3:
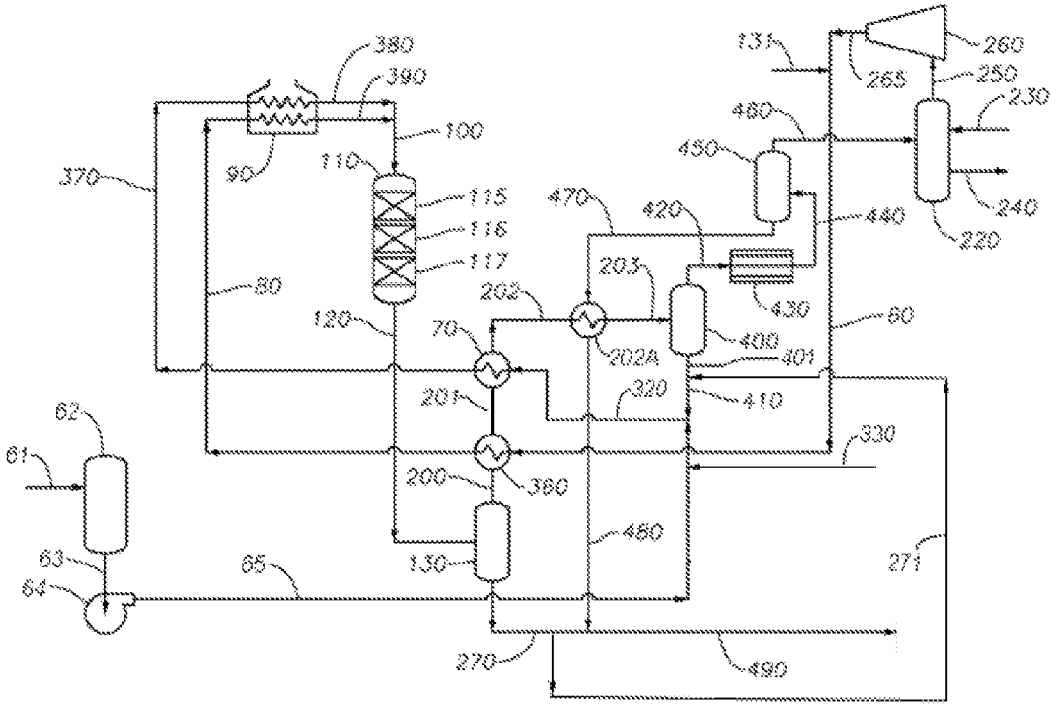

It may be desired to separate the total vapor product after separating the three portions of the hydroprocessed product. Referring to FIG. 3, a tar stream containing SCT and having $I_N$>110 is conducted via conduit 61 to separation stage 62 for separation of SCT and one or more light gases and/or particulates from the tar stream. The SCT is conducted via conduit 63 to pump 64 to increase the SCT's pressure, the higher-pressure SCT being conducted away via conduit 65. A utility fluid conducted via line 410 is combined with the SCT of line 65, with the tar-fluid mixture being conducted to a tar-fluid mixture pre-heater stage 70 via conduit 320. The utility fluid is utilized during SCT hydroprocessing e.g., for effectively increasing run-length during hydroprocessing and improving SCT properties. Optionally, a supplemental utility fluid, may be added via conduit 330. The combined stream, a tar-fluid mixture which is primarily in liquid phase, is conducted to a supplemental pre-heat stage 90 via conduit 370. The supplemental pre-heat stage can be, e.g., a fired heater. Recycled treat gas is obtained from conduit 265. If needed, fresh treat gas, comprising molecular hydrogen, can be obtained from conduit 131. The treat gas is conducted via conduit 60 to a second pre-heat stage 360, the heated treat gas being conducted to the supplemental pre-heat stage 90 via conduit 80.

The pre-heated tar-fluid mixture (from line 380) is combined with the pre-heated treat gas (from line 390) and then conducted via line 100 to hydroprocessing stage 110. Mixing means are utilized for combining the pre-heated tar-fluid mixture with the pre-heated treat gas in hydroprocessing stage 110, e.g., one or more gas-liquid distributors of the type conventionally utilized in fixed bed reactors. The SCT is hydroprocessed in the presence of the utility fluid, supplemental utility fluid, the treat gas, and hydroprocessing catalyst in at least one catalyst bed 115. Additional catalyst beds, e.g., 116, 117, etc., with optional intercooling quench using treat gas, from conduit 60 provided between beds (not shown).

In this embodiment, the hydroprocessed effluent is conducted directly from hydroprocessing stage 110 via conduit 120 to separation stage 130 (in one embodiment, a flash drum). Relocating the pre-heater stages 70 and 360 from conduit 120 (as in FIG. 2) to conduit 200 (FIG. 3) increases the amount of vapor leaving separation stage 130 via conduit 200. A bottoms stream is separated in stage 130 from the hydroprocessed effluent and may be carried away from stage 130 via conduit 270. The vapor leaving stage 130 is cooled in exchangers 360, 70, and 202A, to form vapor and liquid phases which are conducted via conduits 200, 201, 202, and 203 to separation stage 400 (in one embodiment, a flash drum). A mid-cut stream is separated in stage 400 and conducted via conduit 401. The remaining vapor is separated in stage 400 and conducted via conduit 420 to condenser 430 where it is further cooled to form, yet again, vapor and liquid phases. The vapor and liquid from condenser 430 are conducted via conduit 440 to separation stage 450 where a light (relative to the bottoms and mid-cut) liquid overhead stream is separated and conducted via conduit 470. The overhead stream 470 is further cooled via exchanger 202A and then may be carried away separately via conduit 480 or combined with bottoms stream 270 and carried away via conduit 490.

The vapor in separation stage 450 is separated to form a total vapor product. The total vapor product is conducted away from stage 450 via conduit 460 to upgrading stage 220, which comprises, e.g., one or more amine towers. Fresh amine is conducted to stage 220 via line 230, with rich amine conducted away via conduit 240. At least a portion of the upgraded treat gas is conducted away from stage 220 via conduit 250, compressed in compressor 260, and conducted via conduits 265, 60, 80, and 390 for re-cycle and re-use in the hydroprocessing stage 110.

In order to provide the desired utility fluid, a portion of the higher boiling point molecules in the bottoms stream 270 may be combined via line 271 with the mid-cut 401 to form a heavy mid-cut stream 410. At least a portion of the heavy mid-cut stream 410 is utilized as utility fluid and conducted via pump 300 and conduit 310. The utility fluid comprises ≥10 wt. % of the heavy mid-cut stream, based on the weight of the utility fluid.

Preferably, the boiling point distribution of heavy mid-cut 410 has properties desired for utility fluid. Heavy mid-cut 410 can have a true boiling point distribution having an initial boiling point ≥177° C. (350° F.) and a final boiling point ≤566° C. (1050° F.). The heavy mid-cut stream can also have a true boiling point distribution having an initial boiling point ≥177° C. (350° F.) and a final boiling point ≤430° C. (800° F.). The heavy mid-cut stream can have $S_{BN}$≥120, ≥125, or ≥130.

The utility fluid is utilized in hydroprocessing the tar stream, e.g., for effectively increasing run-length during hydroprocessing. The relative amounts of utility fluid and tar stream during hydroprocessing are generally in the range of from about 20.0 wt % to about 95.0 wt % of the tar stream and from about 5.0 wt % to about 80.0 wt % of the utility fluid, based on total weight of utility fluid plus tar stream. For example, the relative amounts of utility fluid and tar stream during hydroprocessing can be in the range of (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid. In an embodiment, the utility fluid: tar weight ratio can be ≥0.01, e.g., in the range of 0.05 to 4.0, such as in the range of 0.1 to 3.0, or 0.3 to 1.1. At least a portion of the utility fluid can be combined with at least a portion of the tar stream within the hydroprocessing vessel or hydroprocessing zone, but this is not required, and in one or more embodiments at least a portion of the utility fluid and at least a portion of the tar stream are supplied as separate streams and combined into one feed stream prior to entering (e.g., upstream of) the hydroprocessing stage(s). For example, the tar stream and utility fluid can be combined to produce a feedstock upstream of the hydroprocessing stage, the feedstock comprising, e.g., (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid, the weight percents being based on the weight of the feedstock. The feedstock can be conducted to the hydroprocessing stage for the hydroprocessing.

Hydroprocessing of the tar stream in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the tar stream in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt % of one or more metals selected from Groups 6, 8, 9, and 10 of the Periodic Table and (ii) ≥1.0 wt % of an inorganic oxide, the weight percents being based on the weight of the catalyst.

In one or more embodiments, the catalyst is a bulk multimetallic hydroprocessing catalyst with or without binder. In an embodiment the catalyst is a bulk trimetallic catalyst comprised of two Group 8 metals, preferably Ni and Co and the one Group 6 metals, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

Hydroprocessing the specified amounts of tar stream and utility fluid using the specified hydroprocessing catalyst and specified utility fluid leads to improved catalyst life, e.g., allowing the hydroprocessing stage to operate for at least 3 months, or at least 6 months, or at least 1 year without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the tar stream and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 S $m^3/m^3$) to 5000 SCF/B (890 S $m^3/m^3$), in which B refers to barrel of feed to the hydroprocessing stage (e.g., tar stream plus utility fluid). For example, the molecular hydrogen can be provided in a range of from 1000 SCF/B (178 S $m^3/m^3$) to 3000 SCF/B (534 S $m^3/m^3$). Hydroprocessing the tar stream in the presence of the specified utility fluid, molecular hydrogen, and a catalytically effective amount of the specified hydroprocessing catalyst under catalytic hydroprocessing conditions produces a hydroprocessed product including, e.g., upgraded SCT. Preferably, the amount of molecular hydrogen required to hydroprocess the specified tar stream is less than if the tar stream contained higher amounts of $C_{6+}$ olefin, for example, vinyl aromatics. Optionally, higher amounts of molecular hydrogen may be supplied, for example, when the tar stream contains relatively higher amounts of sulfur. An example of suitable catalytic hydroprocessing conditions will now be described in more detail. The invention is not limited to these conditions, and this description is not meant to foreclose other hydroprocessing conditions within the broader scope of the invention.

The hydroprocessing is generally carried out under hydroprocessing conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The specified tar stream generally contacts the hydroprocessing catalyst in the vessel or zone, in the presence of the utility fluid and molecular hydrogen. Catalytic hydroprocessing conditions can include, e.g., exposing the combined diluent-tar stream to a temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Liquid hourly space velocity (LHSV) of the combined diluent-tar stream will generally range from 0.1 $h^{-1}$ to 30 $h^{-1}$, or 0.4 $h^{-1}$ to 25 $h^{-1}$, or 0.5 $h^{-1}$ to 20 $h^{-1}$. In some embodiments, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, or 20 bar to 120 bar, or 20 bar to 100 bar, a space velocity (LHSV) in the range of 0.1 to 5.0, and a molecular hydrogen consumption rate of about 53 standard cubic meters/cubic meter (S $m^3/m^3$) to about 445 S $m^3/m^3$ (300 SCF/B to 2500 SCF/B, where the denominator represents barrels of the tar stream, e.g., barrels of SCT). In one or more embodiment, the hydroprocessing conditions include one or more of a temperature in the range of 380° C. to 430° C., a pressure in the range of 21 bar (absolute) to 81 bar (absolute), a space velocity in the range of 0.2 to 1.0, and a hydrogen consumption rate of about 70 S $m^3/m^3$ to about 267 S $m^3/m^3$ (400 SCF/B to 1500 SCF/B). When operated under these conditions using the specified catalyst, TH hydroprocessing conversion is generally ≥25.0% on a weight basis, e.g., ≥50.0%.

Using the specified utility fluid, the amount of coking in the hydroprocessing or contacting zone is relatively small and run lengths ≥10 days, or ≥25 days, or ≥50 days, or ≥80 days are observed with ≤10.0%, preferably ≤1% increase in reactor pressure drop over its start-of-run ("SOR") value, as calculated by ([Observed pressure drop −Pressure $drop_{SOR}$]/Pressure $drop_{SOR}$)*100%. Additionally, SCT hydroprocessing in accordance with the invention can reduce reactor pressure drop when that reactor was previously operated with lower SBN tar-utility fluid feed mixture.

Blending Hydroprocessed Product

Example 1

Figure 4:
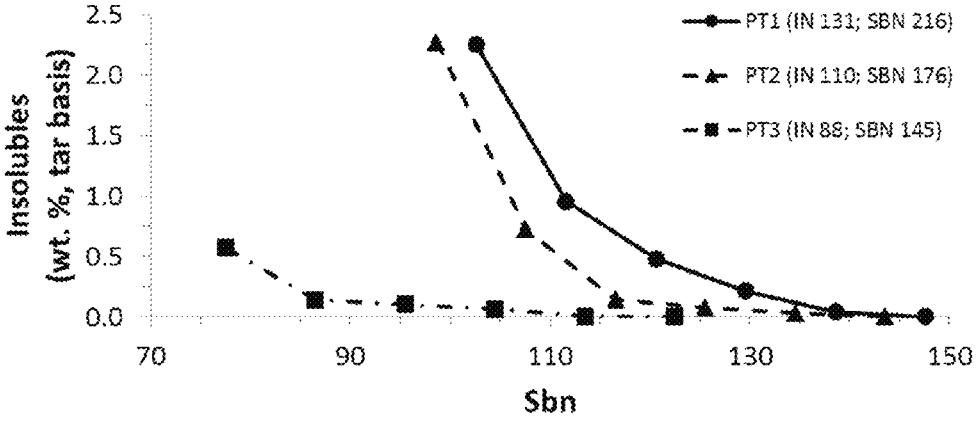
FIG. 4 illustrates the precipitate concentration for pyrolysis tar-solvent mixtures using three pyrolysis tars; PT1, PT2, and PT3.

FIG. 4 illustrates the precipitate concentration for pyrolysis tar-solvent mixtures using three pyrolysis tars; PT1, PT2, and PT3. The mixtures were made using a volume ratio of 9:1 of solvent:tar (9 parts solvent:1 part tar). As $S_{BN}$ of the mixtures was lowered, precipate concentration increased. For PT1 and PT2, precipitate formation occurred below a mixture $S_{BN}$<140. For PT3, precipitate formation occurred below a mixture $S_{BN}$<115. The precipitates formed at higher mixture SBN for the pyrolysis tars having higher $I_N$≥110 (PT1 has $I_N$=131 and PT2 has $I_N$=110 while PT3 has $I_N$=88).

Example 2

Figure 5:
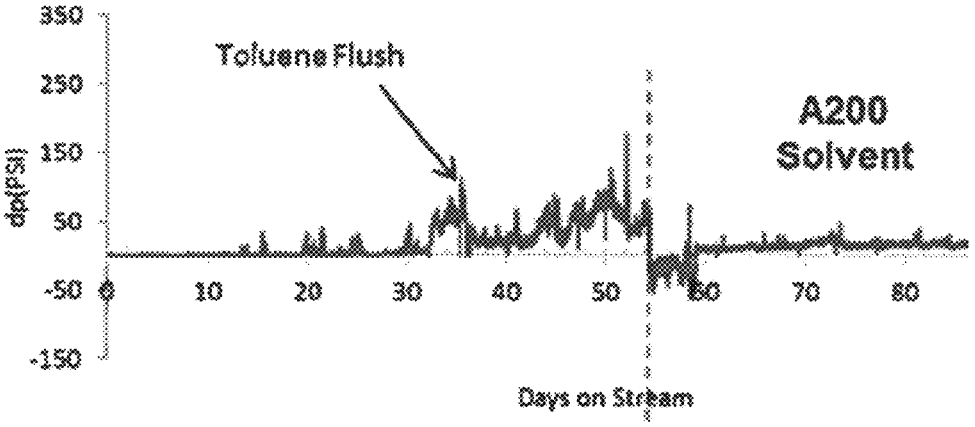
FIGS. 5, 6, and 7 illustrate the pressure drop across a pyrolysis tar hydroprocessing reactor.

FIG. 5 illustrates the pressure drop across a pyrolysis tar hydroprocessing reactor over the course of a 90 day run. A 45.7 cm length of ⅜ inch (0.9525 cm) SS tubing was used as a reactor. The reactor was completely loaded with commercial NiMo oxide on alumina hydrotreating catalyst (RT-621).

The reactor was sulfided by flowing a 20 wt % solution of dimethyldisulfide in isopar M through the packed reactor at 0.042 mL/min for 1 hour at 100° C., then for 12 hours at 240° C., and finally for 60 hours at 340° C. The sulfiding procedure was performed while flowing 20 standard cubic centimers per minute (sccm) $H_2$ at 1000 psig of pressure.

After sulfiding, the reactor temperature was increased to 400° C. and $H_2$ flow increased to 3000 scfb (118 sccm). 100.0 wt % of a feedstock was provided to the reactor (day 0) flowing at 1.0 $hr^{-1}$ weight hourly space velocity (WHSV). The feedstock comprised 50.0 wt % of steam cracker tar (SCT) having $I_N$=110 and 50.0 wt % trimethylbenzene (TMB) solvent having $S_{BN}$=95. The combined tar-solvent feed mixture had $S_{BN}$≈123.

The pressure drop across the reactor built slowly. A toluene solvent wash near day 35 was unsuccessful at reducing pressure drop in the reactor. Flow to the reactor was stopped at day 54. At day 60, the reactor was restarted at the same conditions except that Aromatic 200™ having $S_{BN}$≤130 available from ExxonMobil Chemical was used as solvent instead of the TMB. The combined tar-solvent feed mixture $S_{BN}$ using Aromatic 200 was $S_{BN}$≈154. The pressure drop across the reactor decreased dramatically when the solvent was changed. The deplugging resulted from the increase in $S_{BN}$ which allowed the dissolution of precipitated asphaltenes deposited in the reactor. The pressure drop across the reactor remained low until the remainder of the SCT was processed (day 87) for a duration of approximately 25 days.

Example 3

Figure 6:
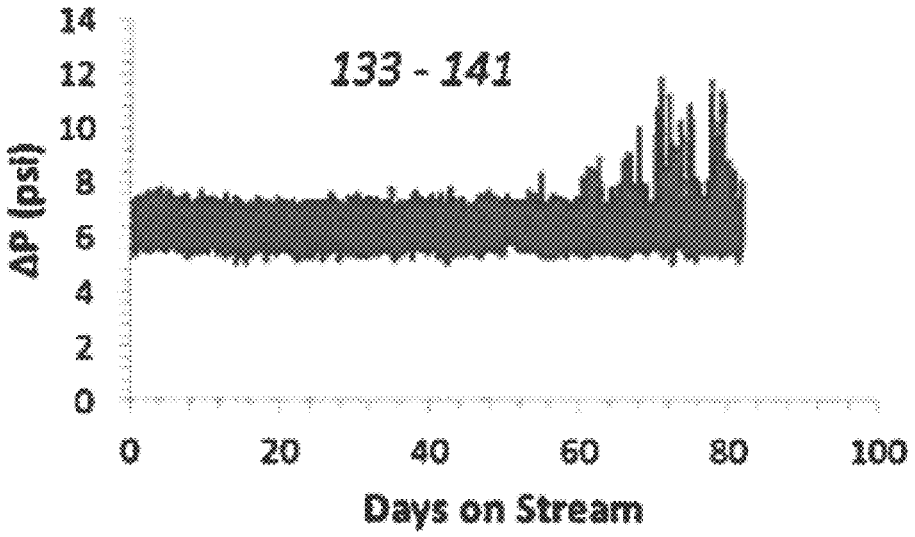

FIG. 6 illustrates the pressure drop across a pyrolysis tar hydroprocessing reactor over the course of an 80 day run. A hydroprocessing reactor was prepared following same method as used in Example 2.

After sulfiding, the reactor temperature was increased to 400° C. and $H_2$ flow increased to 3000 scfb (118 sccm). 100.0 wt % of a feedstock was provided to the reactor (day 0) flowing at 1.0 $hr^{-1}$ weight hourly space velocity (WHSV). The feedstock comprised 50.0 wt % of SCT having $I_N$=110 and 50.0 wt % mid-cut solvent having a higher $S_{BN}$ than TMB solvent used in Example 2. The combined tar-solvent feed mixture had $S_{BN}$≈133-141. The higher SBN mid-cut solvent extended run duration to about day 60 before noticeable pressure drop appeared across reactor.

Example 4

Figure 7:
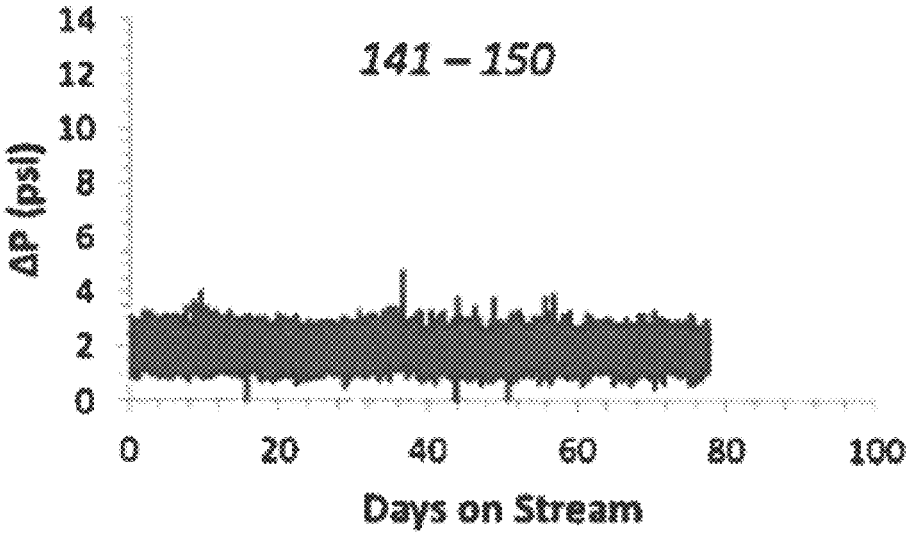

FIG. 7 illustrates the pressure drop across a pyrolysis tar hydroprocessing reactor over the course of an 80 day run. A hydroprocessing reactor was prepared following same method as used in Example 2.

After sulfiding, the reactor temperature was increased to 400° C. and $H_2$ flow increased to 3000 scfb (118 sccm). 100.0 wt % of a feedstock was provided to the reactor (day 0) flowing at 1.0 $hr^{-1}$ weight hourly space velocity (WHSV). The feedstock comprised 50.0 wt % of SCT having $I_N$=110 and 50.0 wt % heavy mid-cut solvent having a higher $S_{BN}$ than mid-cut solvent used in Example 3. The combined tar-solvent feed mixture had $S_{BN}$≈141-150. The higher SBN heavy mid-cut solvent did not show any signs of reactor pressure drop for the entire length of the run.

Example 5

The hydroprocessed pyrolysis tar product (hydroprocessed product) can be blended with heavy hydrocarbons such as fuel oil. Table 1 provides properties of a fuel oil (FO1), two pyrolysis (steam cracker) tars (PT4 and PT5), and the corresponding hydroprocessed product of those steam cracker tars (HP4 and HP5).

TABLE 1

| | PT4 | PT5 | HP4 | HP5 | FO1 |
|---|---|---|---|---|---|
| S.G. at 15° C. | 1.12 | 1.13 | 0.98 | — | 0.98 |
| API 60° F. | −4.8 | −6.2 | 12.9 | — | 12.6 |
| Viscosity (cSt) at 50° C. | 998 | 10400 | 6.7 | — | 12 |
| MCRT (wt %) | 18.9 | 23.8 | 4.7 | 8.4 | 16.8 |
| Sbn | 142 | 154 | 110 | 122 | 89 |
| IN | 92 | 106 | 42 | 60 | 43 |

A pyrolysis tar/fuel oil mixture of 10% PT4 and 90% FO1 by volume was prepared. This mixture was monitored for up to 30 days for onset of precipitated solids. Sediment was determined by obtaining a drop of mixture and observing the sample on a microscope slide with a cover slip applied to thin the sample. A 200× microscope (Leitz, Model 050260) was used to observed precipitation. Precipitation was observed in less than a 24 hour period.

Hydroprocessed products HP4 and HP5 were prepared by hydroprocessing PT4 and PT5 (in corresponding order) at 0.50 $hr^{-1}$ weight hourly space velocity (WHSV) feed rate under similar conditions described in examples above. A hydroprocessed product/fuel oil mixture of 10% HP4 and 90% FO1 by volume was prepared. A second hydroprocessed product/fuel oil mixture of 10% HP5 and 90% FO1 by volume was also prepared. Drops of oil were removed after 24 hours and weekly up to 30 days and monitored for sediment formation by the method described (by microscope). No precipitates were observed.

Because precipitation can sometimes be delayed because of kinetic factors, an accelerated test was performed on the three previous mixtures. A heptane-toluene ("heptol") solvent was prepared by mixing 10% n-heptane and 90% toluene by volume to represent a bulk liquid having $S_{BN}$ of about 90. A sample of 1 part PT4/FO1 mixture by weight was combined with 5 parts heptol solvent by volume to reduce viscosity and aid kinetics of precipitation (if any). A precipitate was observed within 5 minutes. Conversely, similar heptol mixtures of HP4/FO1 and HP5/FO1 were prepared and monitored. No precipitates were observed over 30 days of observation.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a pyrolysis feedstock comprising ≥10.0 wt. % hydrocarbon based on the weight of the pyrolysis feedstock;

(b) pyrolysing the pyrolysis feedstock to produce a pyrolysis effluent comprising pyrolysis tar and ≥1.0 wt. % of $C_2$ unsaturates, based on the weight of the pyrolysis effluent;

(c) separating at least a portion of the pyrolysis tar from the pyrolysis effluent, wherein the separated pyrolysis tar has $I_N$>110 and ≥90 wt. % of the pyrolysis effluent's molecules have an atmospheric boiling point of ≥290° C.;

(d) providing a utility fluid, the utility fluid comprising ring aromatics, in an amount ≥25.0 wt. % based on the weight of the utility fluid, and the utility fluid having $S_{BN}$≥120;

(e) combining at least a portion of the separated pyrolysis tar and utility fluid;

(f) providing treat gas comprising molecular hydrogen;

(g) hydroprocessing the combined pyrolysis tar and utility fluid in a hydroprocessing zone in the presence of treat gas under catalytic hydroprocessing conditions to produce hydroprocessed effluent, comprising hydroprocessed tar;

(h) separating from the hydroprocessed effluent a bottoms stream and a first vapor stream;

(i) separating from the first vapor stream a mid-cut stream and a second vapor stream;

(j) separating from the second vapor stream a light liquid overhead stream and a total vapor product;

(k) combining at least a portion of the mid-cut stream with at least a portion of the bottoms stream to form a heavy mid-cut stream, the heavy mid-cut stream having $S_{BN}$≥120; and (l) conducting at least a portion of the heavy mid-cut stream to step (d), wherein the utility fluid comprises ≥10.0 wt. % of the heavy mid-cut stream, based on the weight of the utility fluid.

2. The process of claim 1, wherein the pyrolysis tar has $I_N$>130.

3. The process of claim 1, wherein the utility fluid has a $S_{BN}$≥130.

4. The process of claim 1, wherein the combined pyrolysis tar and utility fluid in step (e) has a $S_{BN}$≥140.

5. The process of claim 1, wherein the combined pyrolysis tar and utility fluid in step (e) has a $S_{BN}$≥150.

6. The process of claim 1, wherein the utility fluid has a true boiling point distribution having (i) an initial boiling point ≥177° C. and (ii) a final boiling point ≤566° C.

7. The process of claim 1, wherein the utility fluid has a true boiling point distribution having (i) an initial boiling point ≥177° C. and (ii) a final boiling point ≤430° C.

8. The process of claim 1, wherein the utility fluid comprises ≥25.0 wt % two ring and/or three ring aromatic compounds.

9. The process of claim 1, wherein the pyrolysis feedstock hydrocarbon comprises one or more of naphtha, gas oil, vacuum gas oil, waxy residues, atmospheric residues, residue admixtures, or crude oil.

10. The process of claim 1, wherein the pyrolysis effluent's tar comprises (i) ≥10.0 wt. % of molecules having an atmospheric boiling point ≥565° C. that are not asphaltenes, and (ii) ≤$1.0\times10^3$ ppmw metals, the weight percents being based on the weight of the pyrolysis effluent's tar.

11. The process of claim 1, wherein (i) the hydroprocessing in step (g) is conducted continuously in a hydroprocessing zone from a first time $t_1$ to a second time $t_2$, $t_2$ being ≥($t_1$+80 days) and (ii) hydroprocessing zone's pressure drop at the second time is increased ≤10.0% over the pressure drop at the first time.

* * * * *